United States Patent [19]

Compagnucci

[11] Patent Number: 4,570,871

[45] Date of Patent: Feb. 18, 1986

[54] SUPPORT FOR THE WINDING OF PACKAGES OF WIRE

[75] Inventor: Rossano Compagnucci, Osimo, Italy

[73] Assignees: Ferriere Nord S.p.A., Osoppo; Silo S.p.A., Santa Maria Nuova, both of Italy

[21] Appl. No.: 666,740

[22] Filed: Oct. 31, 1984

[30] Foreign Application Priority Data

Nov. 14, 1983 [IT] Italy ..... 83499 A/83

[51] Int. Cl.[4] ..... B65H 75/20

[52] U.S. Cl. ..... 242/77.2

[58] Field of Search ..... 242/77.2, 129

[56] References Cited

U.S. PATENT DOCUMENTS

| | | | |
|---|---|---|---|
| 379,841 | 3/1888 | Whitmore | 242/77.2 |
| 1,095,298 | 5/1914 | Thorspeck | 242/77.2 |
| 1,156,569 | 10/1915 | Watkins | 242/77.2 |
| 1,932,059 | 10/1933 | White | 242/77.2 |
| 1,972,723 | 9/1934 | White | 242/77.2 |
| 4,032,078 | 6/1977 | Van de Loock | 242/77.2 |
| 4,089,485 | 5/1978 | Van de Loock | 242/77.2 |

*Primary Examiner*—Donald Watkins
*Assistant Examiner*—Lloyd D. Doigan
*Attorney, Agent, or Firm*—Wegner & Bretschneider

[57] ABSTRACT

This invention concerns a support (10) for the winding of packages of wire and, in particular but not restricted to such application, of filler rod for welding purposes, which support (10) comprises circumferential metallic rod elements (11) and provides socket means (13) for cooperation with an unwinding device, being suitable for momentary cooperation with winding means and including:

a plurality of substantially U-shaped elements (12) made of bent rod which are positioned with a substantially radial axis and are welded at their ends to the circumferential elements (11), neighbouring U-shaped elements (12) being welded to each other in correspondence with a central portion (13) of the support (10), and a plurality of cross piece elements (16) welded at their ends (116–216) respectively to at least partially corresponding U-shaped elements (12) of two bases (15–115) of the support (10).

20 Claims, 4 Drawing Figures

SUPPORT FOR THE WINDING OF PACKAGES OF WIRE

This invention concerns a support for the winding of packages of wire. To be more exact, the invention concerns a support able to form packages of wire by winding and, in particular but not restricted to such application, packages of filler rod for welding purposes.

The invention can be employed also to wind any filiform material or material related thereto, such as plastic pipes or other products, for instance.

The invention can be used to wind packages of wire of various types, such as metallic wire, plastic cord, sheathed wire or yet other types.

It is known that in the winding of packages of wire the evenness of the winding of the coils of wire on the supports employed is particularly important.

In fact, such evenness facilitates greatly the subsequent unwinding and usage operations by eliminating any entangling of the wire thus wound.

Moreover, a regular arrangement of the coils alongside each other prevents, during the unwinding, any obstructions of the wire which might lead to breakage of the same by a tugging action.

Important features of the supports for such winding are, therefore, their ability to provide the coils of wire with a proper support, as regular as possible, and also their ability to be deformed as little as possible not only during winding and unwindling but also during handling, carriage and storage.

Supports for such winding are known which consist of plastic materials of various types. These supports have a central cylindrical body, about which the wire is wound, and two lateral flanges able to hold the package of wire at its sides.

Owing to the very wide tolerances involved in the manufacturing processes, however, such plastic supports entail problems regarding the winding and subsequent unwinding of the wire (in fact, the wire tends to become wound eccentrically) and also require great care in obtaining regular winding.

Moreover, such supports made of a plastic material break or become worn very easily during transport and use.

Supports for the winding of wire are also known which consist of metallic rod elements suitably bent and welded together.

During winding these types of support cooperate with removable flange elements able to provide an inner cylindrical surface for the winding of coils and also side surfaces to hold such coils.

The removable flange elements comprise channels or hollows able to lodge parts of the support.

An assemblage is thus formed with substantially regular surfaces for the winding.

After winding has been completed, the removable winding element is dismantled, and the wound wire is rested only on the support made of welded rods. The winding tensions are loaded onto such support.

The support therefore has to possess enough rigidity to prevent deflections which could lead to an irregular mutual arrangement of the coils and/or a difficult and irregular unwinding.

For instance, patent IT No. 1.049.684 in the name of Stein is known and discloses the construction of a support by joining together by welding a given number of bent metallic rod elements.

These elements are such that, when joined together, they form a series of U-shaped stirrups connected together with peripheral circumferential arcs.

The main shortcoming of this structure lies in the low rigidity of the whole assemblage. In fact, no cross members or other reinforcing elements are included to stiffen the structure axially or circumferentially.

A resulting drawback consists in the fact that the structure cannot absorb the winding tension of the material thus wound without excessive deformation when the support has been withdrawn from the removable flange element with which the support itself cooperates during the winding.

Another drawback is the easy deformation of the packages of wire wound on such support when they are being handled, transported and used.

Moreover, this device requires an additional element, such as an adapter, so that it can cooperate with the shaft of the winding machine or unwinding support.

In fact, such support for the winding of wire does not comprise socket means or the like to perform such cooperation.

Another known embodiment is disclosed as well in patent IT No. 1.009.680 also in the name of Stein. That patent discloses a support consisting of two circular welded-rod elements joined together with U-shaped stirrups which form the support of the various coils.

This kind of support too is not very rigid, mainly in the axial direction, owing to the low rigidity of such U-shaped stirrups.

Moreover, this support, like that of the cited IT No. 1.049.684, requires an adapter for use on an unwinding machine since it lacks a socket or like means.

An analogous support for winding purposes is disclosed in FR No. 2.272.941.

U.S. Pat. No. 1,932,059 discloses a support made of welded rod and consisting of two bases joined together by cross frames. The wire is wound on these cross frames. Each base consists of elements made of bent rod and variously conformed and welded together, with or without an outer stiffening circle and possible with a central core.

U.S. Pat. No. 2,233,449 discloses a reel which can be dismantled and of which the elements are united with a fixed joint; this invention cannot ensure a high degree of rigidity, which is instead the main purpose of our present invention; moreover, this U.S. reel has a complex structure owing to the inclusion of interconnecting stirrups.

U.S. Pat. No. 1,396,450 discloses a reel of which the core is formed with only three cross frames, thus causing a prismatic and not circular winding; the structure is generally light and ill adapted to heavy windings, such as the winding of welding rod, for instance.

U.S. Pat. No. 2,566,867 discloses a light support specifically for garden hoses, with bases consisting of "V"-shaped sections welded at their ends to a stiffening circle and of cross bars to support the wound hose.

U.S. Pat. No. 1,972,723 (White) discloses supports which have bases like those of the supports described in U.S. Pat No. 1,932,050. The central core consists of a cylinder of sheet metal welded to such bases. This embodiment seems heavy and wasteful and, moreover, does not provide a support made wholly of welded wire or rod.

U.S. Pat. No. 4,089,485 describes another type of support which consists of a set of elements having the form of segments of a cylinder, each of such elements being constituted by a bent rod.

Each of such elements comprises a stirrup made by bending and arranged axially to the support. Each element is obtained only by bending rod material, and the various elements with the form of a segment of a cylinder are welded together to constitute the whole support.

Such type of support, as compared to the types described earlier, provides the considerable advantage of not requiring a central adapter for its positioning on the shaft of an unwinding machine, such as a welding machine which employs filler rod held on such support.

In fact, the conformation of the cylindrical segment elements is such that, when such elements are united and welded together, they provide a central socket having a substantially circular shape and able to cooperate with such shaft.

However, this embodiment too entails various shortcomings. A first shortcoming is the great quantity of material (metallic rod) needed for its construction.

Moreover, the various elements are joined together with weld points which are not particularly strong and which do not contribute towards stiffening such assemblage, the sections of the metallic rods at such weld points being slender.

Furthermore, the axial cross pieces on which the wire rests are embodied with a bent segment of the elements of which the whole assemblage consists, such segment being very little rigid as compared to the rigidity obtainable with welded cross pieces, for instance.

The whole assemblage, therefore, owing to its very nature does not possess enough rigidity and yet it is heavy and hard to construct.

Another defect of this embodiment lies in the fact that it is hard to weld together the various elements forming the product and to maintain a proper coplanar positioning of such elements in correspondence with the circular bases of the support which form the lateral flanges to contain the package of wire. In fact, neighbouring elements are often slightly staggered in an axial direction.

This means that, if regular winding is to be obtained, the radial elements of the support have to be inserted more deeply within the corresponding hollows in the removable winding means.

As a result, when the completed reel of wire is withdrawn from the removable element, the coils tend to sag sideways very slackly against the flanges of the support, and thus the coils tend to become disassembled as they are not sustained properly.

A purpose of the present invention is to overcome the drawbacks and shortcomings described above by providing a support for the winding of packages of wire which is very rigid both axially and circumferentially and radially.

Moreover, the invention is intended to optimize the quantity of material employed to construct such support, that is to say, it is desired to obtain a maximum rigidity of the assemblage together with a minimum waste of material.

Another purpose of the invention is to obtain a proper sustainment for the filiform material wound onto the containing surfaces.

The support of the invention itself provides central socket means to cooperate with the shaft of the unwinding support or machine. Adapter means are therefore not required.

The purposes of the invention are fulfilled by the fact that a support is provided which consists of bent rod elements which have union points and bends such as to obtain a structure reinforced in all three dimensions.

The conformation according to the invention provides a general strengthening in all three dimensions.

In particular, rigidity in the axial direction is obtained by uniting the various elements forming the base flanges of the support by means of welded cross pieces.

Such cross pieces are considerably more rigid than stirrups obtained by bending and also enable an almost perfect perpendicular positioning of the cross pieces to be obtained in relation to the lateral elements, which are arranged substantially in a radial direction and on which the wound wire rests at its sides.

In this way there are obtained a maximum regularity of distribution of the coils of wire and a maximum ease of unwinding without the wire jumping on uneven surfaces, as happens in some known embodiments, for instance.

Moreover, the elements of the invention are conformed in such a way as to provide a central socket suitable for immediate cooperation with the shaft of the unwinding machine.

The elements forming the two bases of the support can be arranged in correspondence with each other or be staggered.

When the elements are arranged in correspondence with each other, the legs of one element on one of the bases correspond substantially with the respective legs of an element on the other base and are united to the same by means of the welded cross pieces.

When the elements are staggered in relation to each other, the legs of one element on one base are located in correspondence with, and are united with cross pieces to, the legs of separate neighbouring elements on the other base.

According to the invention it is envisaged that the support undergoes passivation or coating treatments. For instance, the support can be coated by dipping in a bath of a plastic material or the like. This fulfils the twofold purposes of preventing corrosion of the metal of which the support is made and also of obviating any short circuits in welding operations.

The present invention is therefore embodied with a support for the winding of packages of wire and, in particular but not restricted to such application, of filler rod for welding purposes, which support comprises circumferential metallic rod elements and provides socket means for cooperation with an unwinding device, being suitable for momentary cooperation with winding means and being characterized by including:

- a plurality of substantially U-shaped elements made of bent rod which are positioned with a substantially radial axis and are welded at their ends to the circumferential elements, neighbouring U-shaped elements being welded to each other in correspondence with a central portion of the support, and
- a plurality of cross piece elements welded at their ends respectively to at least partially corresponding U-shaped elements of two bases of the support.

We shall describe hereinafter, as a non-restrictive example, a preferred embodiment of the invention with the help of the attached figures, in which:

FIG. 1 is an overall view of the support of the invention;

FIG. 2 gives a perspective of a detail of a joint in the central zone;

Figure 1:
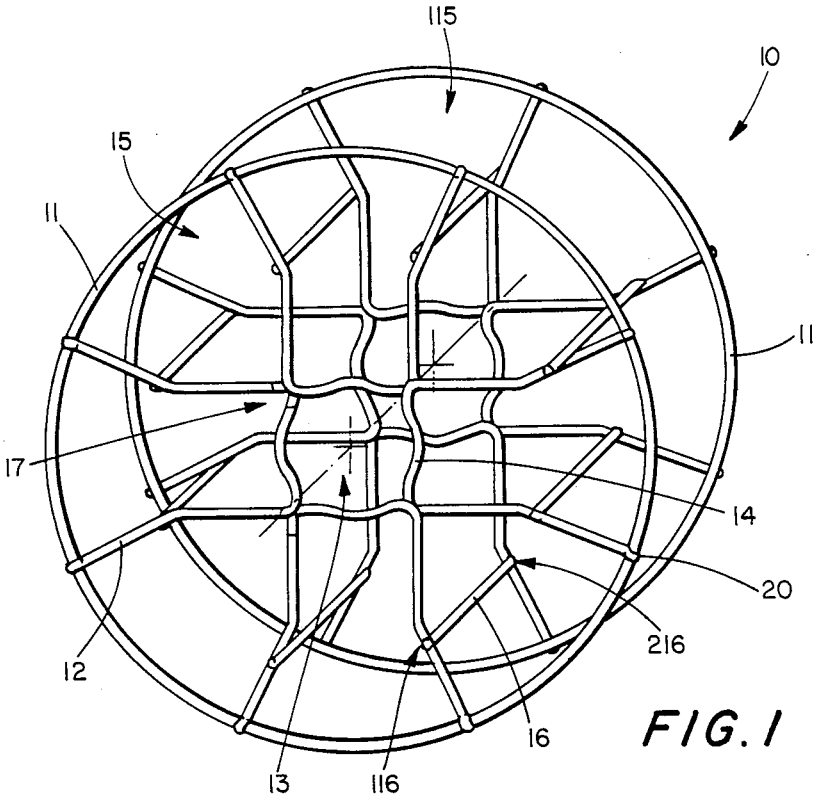

In FIG. 1 a support 10 for the winding of wire comprises two rod elements 11 shaped with a circular form and located on the periphery.

Each of the elements 11 is connected in this figure to four substantially U-shaped elements 12, each of which has a radially disposed axis of symmetry.

Welded connections between the elements 11 and 12 bear the reference number 20.

Each of the elements 12 consists of one single bent rod and comprises, in a central zone or socket 13 of the support 10, an arcuate portion 14 having its centre of curvature substantially in the centre of the support 10.

The arcuate portions 14 of four connected elements 12 form a substantially circular lodgement 13 able to cooperate with a hub of an unwinding machine.

Two bases of the support, which are formed by the union of the elements 12 and bear the references 15 and 115, are joined together by connecting cross pieces 16, which have the twofold function of joining together the two halves 15–115 of the support 10 and of supporting the coils of wire within the support 10.

In the figure each cross piece 16 is welded at 116 and 216 respectively to corresponding elements 12 in the two faces 15–115 of the support 10. In this way a structure which is outstandingly rigid both axially and circumferentially is obtained.

Figure 2:
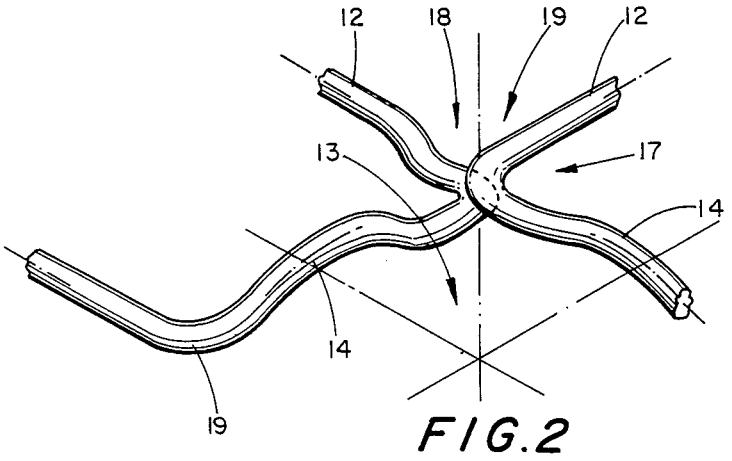

In particular, in the area of the socket 13 the U-shaped elements 12 are united at joints 17. One of such joints 17 is shown in FIG. 2 in particular.

A lower portion 18 of an element 12 serves as a support for a corner 19 of an immediately adjacent element 12.

At the two ends of its curved segment 14 each element 12 comprises a lower segment 18 and a corner 19 coplanar with such curved segment 14 and with the remainder of the element 12.

A structure is thus obtained which, in its central portion corresponding with the socket 13, is reinforced in all three dimensions. The whole assemblage is made extremely rigid in this way.

The employment of cross pieces 16, welded at their two ends 116–216 and uniting the faces or bases 15–115 of the support 10, in cooperation with the three-dimensional structure corresponding to the socket 13 and formed by the spatial superimposition of the corners 18–19 of neighbouring elements 12 imparts maximum rigidity to the support 10, as we said earlier.

Moreover, this condition is obtained by the invention by using an overall length of metallic rod much shorter than that employed to obtain the previously cited known devices which also comprise a central portion or socket.

In fact, the present support 10 is lighter than known devices although it possesses a distinctly greater rigidity than the known embodiments.

Moreover, the fabrication of the support 10 of the present invention is much simpler than that of known embodiments.

Figure 3:
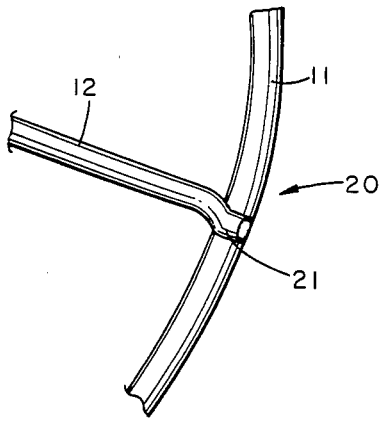
FIG. 3 shows a detail of the welding at the peripheral zone.

FIG. 3 shows a detail of a weld 20 between the end of a "U"-shaped element 12 and the circumferential element 11. According to this embodiment the element 12 has an end 21 bent in a plane substantially perpendicular to the base 15 or 115. This arrangement provides a superimposition of the element 12 on the element 11 on the outer side of the support 10.

There is therefore no risk of contact between the bent end 21 and the filament material being wound onto the support 10.

Figure 4:
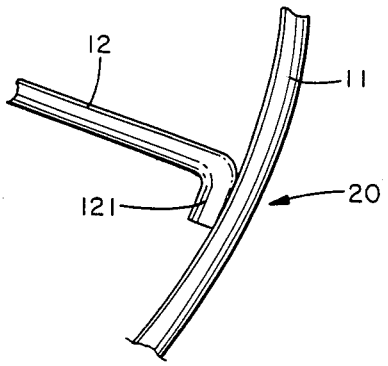
FIG. 4 is a variant of such welding.

FIG. 4 shows a variant in which an end 121 of the element 12 is bent on the same plane as the base 15 or 115 by means of an "L"-shaped elbow. In this case too the end 121 does not protrude outwards from the reel and therefore any risk of contact with the rod being wound is eliminated.

We have described here a preferred embodiment of the present invention, but variants are possible without departing thereby from the scope of the invention.

For instance, it is possible to envisage further reinforcing cross pieces located, for example, in correspondence with a circumference having a diameter smaller than that where the cross pieces 16 are located.

It is possible to adopt another spatial conformation for the cooperation between neighbouring elements 12.

As we said earlier, it is possible to use an arrangement of the U-shaped elements 12 of one face 15 staggered in relation to the elements 12 of the other face 115.

It is also possible to apply to the support various types of surface treatments or coatings such as plastic coating, painting or passivation in various forms.

These and other variants are possible without departing thereby from the scope of the invention.

INDEX

10—support device
11—circumferential elements
12—U-shaped elements
13—socket
14—arcuate portion
15—base or face of the support
115—base or face of the support
16—axial cross pieces
116—welded end
216—welded end
17—joints
18—lower portion
19—angular portion, not lower
20—peripheral weld
120—peripheral weld
21—bent end
121—bent end.

I claim:

1. A support for winding wire and the like comprising continuous circumferential metallic rod elements, a plurality of substantially U-shaped elements each formed of a bent rod having two ends positioned on a substantially radial axis to said circumferential metallic rod elements, and welded at both ends to one of said circumferential metallic rod elements, with neighboring U-shaped elements being welded to each other in correspondence with a central portion of said support to form a rocket portion, and a plurality of cross-piece elements welded at their ends to at least partially corresponding U-shaped elements welded to said circumferential metallic rod elements.

2. The support of claim 1, wherein each U-shaped element includes a substantially arcuate portion corresponding with the socket portion of said support.

3. The support of claim 2, wherein at least one U-shaped element includes at least one lower portion for cooperation with an angular portion of a neighboring U-shaped element.

4. The support of claim 3, wherein the U-shaped elements welded to one circumferential metallic rod element correspond to the U-shaped elements welded to another circumferential metallic rod element.

5. The support of claim 3, wherein the U-shaped elements welded to one circumferential metallic rod element have a shape corresponding to the shape of different U-shaped elements welded to another circumferential metallic rod element.

6. The support of claim 3, wherein the U-shaped elements have at least one end bent substantially in a radial plane and at least partially superimposed on said circumferential metallic rod elements on the outer side thereof.

7. The support of claim 2, wherein the U-shaped elements welded to one circumferential metallic rod element correspond to the U-shaped elements welded to another circumferential metallic rod element.

8. The support of claim 2, wherein the U-shaped elements have at least one end bent substantially in a radial plane and at least partially superimposed on said circumferential metallic rod elements on the outer side thereof.

9. The support of claim 2, wherein the U-shaped elements have at least one end bent substantially in a plane parallel to said circumferential metallic rod elements.

10. The support of claim 9, wherein the U-shaped elements have at least one end bent in the plane of said circumferential metallic rod elements.

11. The support of claim 1, wherein at least one U-shaped element includes at least one lower portion for cooperation with an angular portion of a neighboring U-shaped element.

12. The support of claim 11, wherein the U-shaped elements welded to one circumferential metallic rod element correspond to the U-shaped elements welded to another circumferential metallic rod element.

13. The support of claim 11, wherein the U-shaped elements welded to one circumferential metallic rod element have a shape corresponding to the shape of different U-shaped elements welded to another circumferential metallic rod element.

14. The support of claim 11, wherein the U-shaped elements have at least one end bent substantially in a radial plane and at least partially superimposed on said circumferential metallic rod elements on the outer side thereof.

15. The support of claim 1, wherein the U-shaped elements welded to one circumferential metallic rod element correspond to the U-shaped elements welded to another circumferential metallic rod element.

16. The support of claim 15, wherein the U-shaped elements have at least one end bent substantially in a radial plane and at least partially superimposed on said circumferential metallic rod elements on the outer side thereof.

17. The support of claim 1, wherein the U-shaped elements have at least one end bent substantially in a radial plane and at least partially superimposed on said circumferential metallic rod elements on the outer side thereof.

18. The support of claim 1, wherein the U-shaped elements have at least one end bent substantially in a plane parallel to said circumferential metallic rod elements.

19. The support of claim 18, wherein the U-shaped elements have at least one end bent in the plane of said circumferential metallic rod elements.

20. The support of claim 1, further comprising a surface coating.

* * * * *

UNITED STATES PATENT AND TRADEMARK OFFICE

CERTIFICATE OF CORRECTION

PATENT NO. : 4,570,871

DATED : February 18, 1986

INVENTOR(S) : Rossano COMPAGNUCCI

It is certified that error appears in the above-identified patent and that said Letters Patent is hereby corrected as shown below:

Page 1, item 73, line 1 of the listing of Assignees, replace "Silo" with --Siro--.

Signed and Sealed this

*Fifteenth* Day of *July 1986*

[SEAL]

*Attest:*

DONALD J. QUIGG

*Attesting Officer*

*Commissioner of Patents and Trademarks*